US006766533B1

(12) United States Patent
Meier et al.

(10) Patent No.: US 6,766,533 B1
(45) Date of Patent: Jul. 27, 2004

(54) SWIMSUIT UNDERGARMENT

(76) Inventors: Robin Meier, 546 Hilltop Way, Sublimity, OR (US) 97385; Dee Meier, 546 Hilltop Way, Sublimity, OR (US) 97385

( * ) Notice: Subject to any disclaimer, the term of this patent is extended or adjusted under 35 U.S.C. 154(b) by 0 days.

(21) Appl. No.: 10/417,564

(22) Filed: Apr. 17, 2003

(51) Int. Cl.[7] ..... A41D 7/00
(52) U.S. Cl. ..... 2/67; 2/67; 450/133; 450/135
(58) Field of Search ..... 2/67, 69, 73, 400, 2/401, 402, 406, 78.1–78.4; 450/94, 95, 114, 122–126, 133–137, 155

(56) References Cited

U.S. PATENT DOCUMENTS 1,909,279 A * 5/1933 Just ..... 2/67
3,333,589 A * 8/1967 Cohen et al. ..... 2/67
3,771,172 A * 11/1973 Barg ..... 2/67
4,571,742 A * 2/1986 Wior ..... 2/67
4,701,964 A 10/1987 Bell et al.
4,916,755 A 4/1990 Feigenbaum et al.
RE33,406 E * 10/1990 Wior ..... 2/67
5,586,340 A 12/1996 Russo
5,762,535 A 6/1998 Nishiyama et al.
5,978,963 A * 11/1999 Moskowitz et al. ..... 2/67
5,996,120 A 12/1999 Balit
D423,189 S 4/2000 Davies

* cited by examiner

*Primary Examiner*—Gloria M. Hale

(57) ABSTRACT

A swimsuit undergarment for lifting the buttocks and thighs of a user to provide a slimmer appearance. The swimsuit includes a body member comprising an upper portion and a lower portion. The upper portion of the body member is designed for being positioned on an upper torso of the user. The lower portion is designed for being positioned on a lower torso of the user when the upper portion is positioned on the upper torso of the user. A panel member is adjustably coupled to an interior surface of the lower portion of the body member whereby the panel member is positioned between the lower portion of the body member and the lower torso of the user. The panel member is designed for raising the buttocks and thighs of the user to provide a slimmer appearance when the user is wearing the body member.

11 Claims, 1 Drawing Sheet

SWIMSUIT UNDERGARMENT

BACKGROUND OF THE INVENTION

1. Field of the Invention

The present invention relates to shaping garments and more particularly pertains to a new swimsuit undergarment for lifting the buttocks and thighs of a user to provide a slimmer appearance.

2. Description of the Prior Art

The use of shaping garments is known in the prior art. U.S. Pat. No. 4,916,755 describes a device for shaping and flattening the appearance of the user wearing the swimsuit. Another type of shaping garment is U.S. Pat. No. 4,701,964 having a cover panel coupled to an under garment to provide support and shaping to the body of the user to provide a more aesthetically pleasing appearance. U.S. Pat. No. 5,762,535 has a garment for keeping an upward profile of the hip an buttock line. U.S. Pat. No. 5,586,340 has a garment made of stretch molded material worn by a user to alter the outline of clothes worn over the garment. U.S. Pat. No. 5,996,120 has an outer garment and inner liner where the inner liner comprises a variety of stitch patterns and yarns to provide support for areas of the user's body to accentuate features of the user. U.S. Pat. No. Des. 423,189 shows a swimsuit.

While these devices fulfill their respective, particular objectives and requirements, the need remains for a device that has certain improved features allowing for the user to adjust the amount of lifting of the buttocks.

SUMMARY OF THE INVENTION

The present invention meets the needs presented above by providing a panel member that is adjustably couplable to the lower portion of the body member to allow the user to adjust the amount the buttocks are lifted by the panel member.

Still yet another object of the present invention is to provide a new swimsuit undergarment that lifts up on the thighs to slim the appearance of thighs.

To this end, the present invention generally comprises a body member comprising an upper portion and a lower portion. The upper portion of the body member is designed for being positioned on an upper torso of the user. The lower portion is designed for being positioned on a lower torso of the user when the upper portion is positioned on the upper torso of the user. A panel member is adjustably coupled to an interior surface of the lower portion of the body member whereby the panel member is positioned between the lower portion of the body member and the lower torso of the user. The panel member is designed for raising the buttocks and thighs of the user to provide a slimmer appearance when the user is wearing the body member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
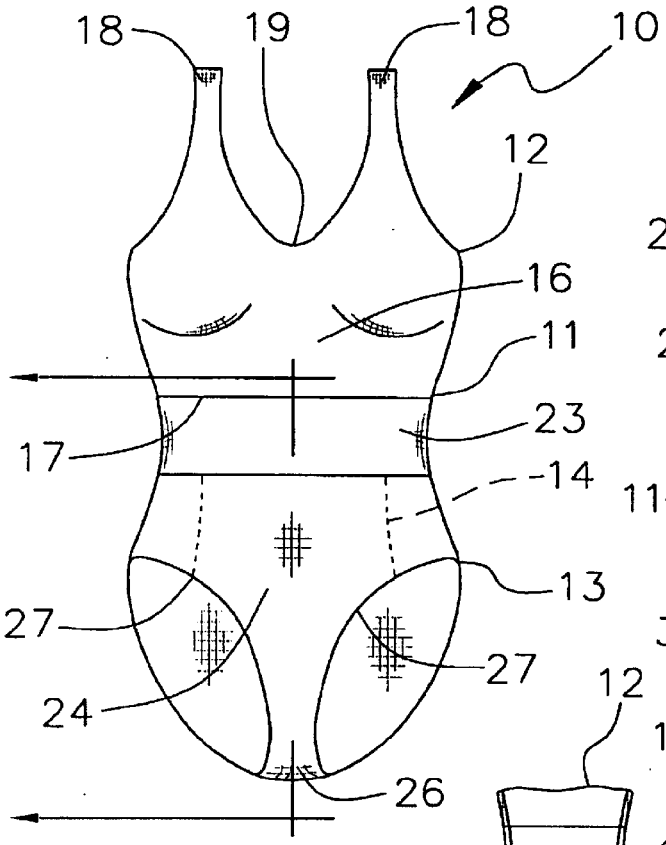
FIG. 1 is a front view of a new swimsuit undergarment according to the present invention.
Figure 2:
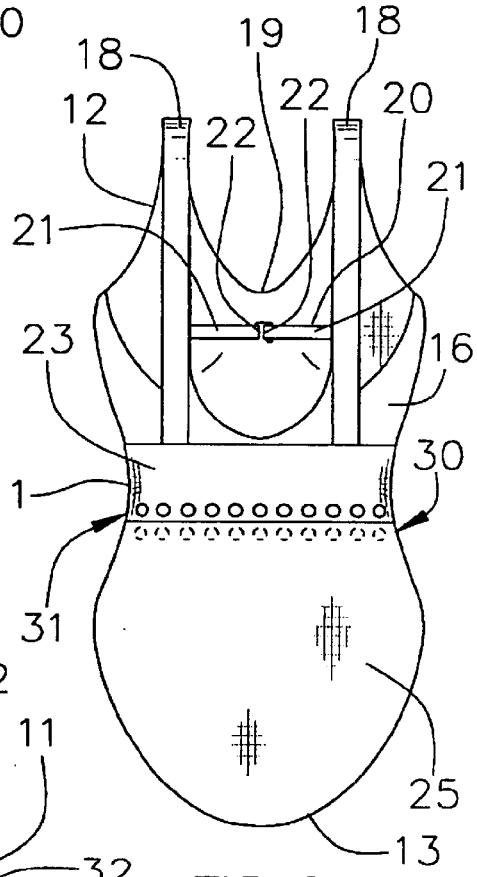
FIG. 2 is a rear view of the present invention.
Figure 3:
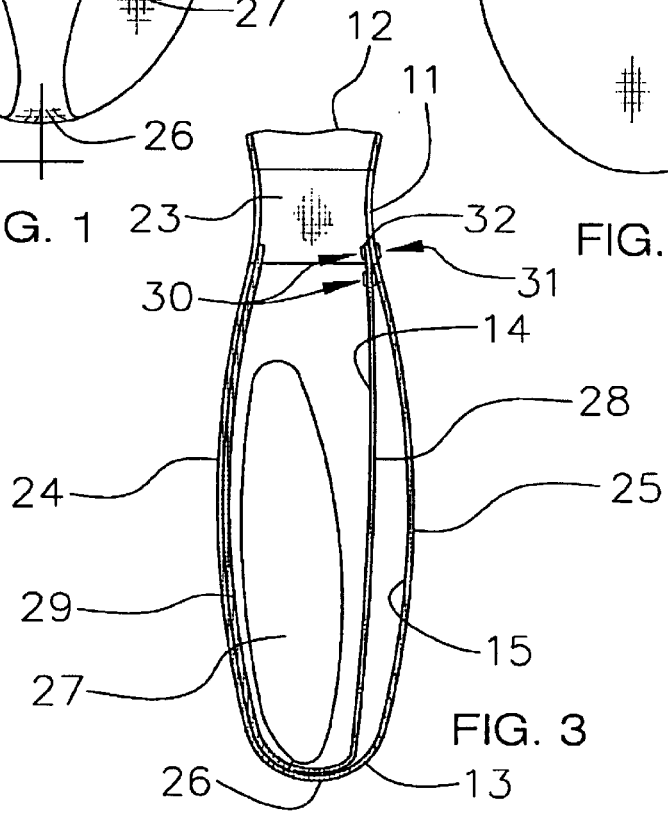
FIG. 3 is a cross-sectional view of the present invention taken along line 3—3 of FIG. 1.

With reference now to the drawings, and in particular to FIGS. 1 through 3 thereof, a new swimsuit undergarment embodying the principles and concepts of the present invention and generally designated by the reference numeral 10 will be described.

As best illustrated in FIGS. 1 through 3, the swimsuit undergarment 10 generally comprises a body member 11 comprising an upper portion 12 and a lower portion 13. The upper portion 12 of the body member 11 is designed for being positioned on an upper torso of the user. The lower portion 13 is designed for being positioned on a lower torso of the user when the upper portion 12 is positioned on the upper torso of the user. The lower portion 13 of the body member 11 comprises a flexible and elastic material. The flexible and elastic material is designed for conforming to the buttocks, pelvic area and stomach area of the user for supporting the buttocks, pelvic area and the stomach area of the user when the user is wearing the body member 11.

A panel member 14 is adjustably coupled to an interior surface 15 of the lower portion 13 of the body member 11 whereby the panel member 14 is positioned between the lower portion 13 of the body member 11 and the lower torso of the user. The panel member 14 is designed for raising the buttocks and thighs of the user to provide a slimmer appearance when the user is wearing the body member 11.

The upper portion 12 comprises a bodice panel 16. A bottom edge 17 of the bodice panel 16 is coupled to the lower portion 13 of the body member 11. The bodice panel 16 is designed for being positioned on a front of the upper torso of user whereby the bodice panel 16 is for supporting the breasts of the user when the body member 11 is being worn by the user. The bodice panel 16 of the upper portion 12 comprises an elastic and flexible material. The elastic and flexible material is designed for forming around the front of the upper torso and breasts of the user for providing support for the breasts of the user.

The upper portion 12 of the body member 11 comprises a pair of strap members 18. Each of the strap members 18 extends between a top edge 19 of the bodice panel 16 and the lower portion 13 of the body member 11 whereby each of the strap members 18 are designed for extending over the shoulder and along a back of the user. Each of the strap members 18 is designed for extending over the shoulders of the user for maintaining positioning of the bodice panel 16 of the upper portion 12 and the lower portion 13 of the body member 11 when the body member 11 is being worn by the user. Each of the strap members 18 comprises a flexible and inelastic material. The flexible and inelastic material is designed for supporting the lower portion 13 of the body member 11 and the panel member 14 for the shoulders of the user and conforming to the curves in the back of the user when the user is wearing the body member 11.

The upper portion 12 of the body member 11 comprises a securing member 20. The securing member 20 extends between the strap members 18 of the upper portion 12 of the body member 11 whereby the securing member 20 is positioned between the bodice panel 16 and the lower portion 13 of the body member 11. The securing member 20 is for maintaining positioning of the strap members 18 when the body member 11 is being worn by the user.

The securing member 20 of the upper portion 12 comprises a pair of securing portions 21. One of the securing portions 21 is coupled to each of the strap members 18. Each of the securing portions 21 comprises a free end 22 whereby the free end 22 of one of the securing portions 21 is selectively couplable to the free end 22 of the other of the securing portion for maintaining positioning of the strap members 18 when the body member 11 is being worn by the user.

The lower portion 13 of the body member 11 comprises a waist member 23. The waist member 23 is coupled to the upper portion 12 of the body member 11 whereby the waist member 23 is designed for being positioned around the waist of the user. The waist member 23 is designed for providing support for the lower portion 13 and the panel member 14 from the waist of the user.

The lower portion 13 of the body member 11 comprises a front member 24, a back member 25 and a pubic member 26. The front member 24 and the back member 25 are coupled to the waist member 23 of the lower portion 13. The pubic member 26 extends between the front member 24 and the back member 25 opposite the waist member 23 whereby the front member 24, the back member 25 and the pubic member 26 define a pair of leg apertures 27 designed for receiving the legs of the user when the user is wearing the body member 11. The front member 24 of the lower portion 13 is designed for being positioned over the pelvic area and stomach area of the user. The back member 25 is designed for being positioned over the buttocks of the user. The pubic member 26 is designed for being positioned against the pubic area of the user.

The panel member 14 comprises a back portion 28. The back portion 28 extends between the pubic member 26 of the lower portion 13 and the waist member 23 of the lower portion 13 whereby the back portion 28 of the panel member 14 is designed for being positioned between the back member 25 of the lower portion 13 and the buttocks of the user when the body member 11 is being worn by the user. The back portion 28 is adjustably couplable to the waist member 23 of the lower portion 13. The back portion 28 of the panel member 14 is designed for engaging the buttocks of the user whereby the back portion 28 of the panel member 14 is for lifting the buttocks of the user and pulling on the thighs of the user for slimming the appearance of the thighs and buttocks of the user when the back portion 28 of the panel member 14 is coupled to the waist member 23 of the lower portion 13. The panel member 14 may comprise a friction resistant material to prevent the buttocks of the user from sliding with respect to said panel member 14.

The panel member 14 comprises front portion 29. The front portion 29 of the panel member 14 extends along the front member 24 of the lower portion 13 from the back portion 28 of the panel member 14 adjacent the pubic member 26 to the waist member 23 of the lower portion 13. The front portion 29 of the panel member 14 is designed for being positioned against the stomach area and pelvic area of the user whereby front portion 29 of the panel member 14 compresses against the stomach area and the pelvic area of the user to provide a flatter appearance to the stomach area and pelvic area of the user.

The panel member 14 comprises a plurality of the sets of first fastener portions 30. Each of the sets of first fastener portions 30 is coupled to the back portion 28 of the panel member 14. Each of the sets of first fastener portions 30 selectively engages a set of second fastener portions 31 coupled to the waist member 23 of the lower portion 13. Each of the sets of first fastener portions 30 is positioned in a spaced relationship to a distal end 32 of the back portion 28 of the panel member 14 whereby the back portion 28 of the panel member 14 is designed for providing greater lift to the buttocks and pulling of the thighs of the user by each of the sets of first fastener portions 30 positioned a greater distance away from the distal end 32 of the back portion 28 of the panel member 14.

In use, the user places their legs through the leg apertures 27 of the lower portion 13 of the body member 11. The lower portion 13 is the pulled over the lower torso of the user and the back portion 28 of the panel member 14 is drawn up so that one of the sets of first fastener portions 30 can be coupled to the set of second fastener portions 31 to secure the back portion 28 of the panel member 14 to the waist member 23 of the lower portion 13 to allow the user to get the desired lift to the buttocks. The back member 25 then conforms to the buttocks of the user to show the slimmer thighs and buttocks. The strap members 18 are then positioned over the shoulders and the free end 22 of one of the securing portions 21 is coupled to the free end 22 of the other of the securing portions 21 to maintain positioning of the strap members 18.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A swimsuit undergarment for providing a slimmer appearance of the user, the swimsuit comprising:

a body member comprising an upper portion and a lower portion, said upper portion of said body member being adapted for being positioned on an upper torso of the user, said lower portion being adapted for being positioned on a lower torso of the user when said upper portion is positioned on the upper torso of the user;

a panel member being adjustably coupled to an interior surface of said lower portion of said body member such that said panel member is positioned between said lower portion of said body member and the lower torso of the user, said panel member being adapted for raising the buttocks such that said panel member pulls on the skin on a portion of the thighs of the user to provide a slimmer appearance to the associated portion of the thighs when the user is wearing said body member;

said lower portion of said body member comprising a waist member, said waist member being coupled to said upper portion of said body member such that said waist member is adapted for being positioned around the waist of the user, said waist member being adapted for providing support for said lower portion and said panel member from the waist of the user;

said lower portion of said body member comprising a front member, a back member and a pubic member, said front member and said back member being coupled to said waist member of said lower portion, said pubic member extending between said front member and said back member opposite said waist member such that said front member, said back member and said pubic member define a pair of leg apertures adapted for receiving the legs of the user when the user is wearing said body member, said front member of said lower portion being adapted for being positioned over the pelvic area and stomach area of the user, said back member being adapted for being positioned over the buttocks of the user, said pubic member being adapted for being positioned against the pubic area of the user; and said panel member comprising a back portion, said back portion extending between said pubic member of said lower portion and said waist member of said lower portion such that said back portion of said panel member is adapted for being positioned between said back member of said lower portion and the buttocks of the user when said body member is being worn by the user, said back portion being adjustably couplable to said waist member of said lower portion, said back portion of said panel member being adapted for engaging the buttocks of the user such that said back portion of said panel member is for lifting the buttocks of the user and pulling on the thighs of the user for slimming the appearance of the thighs and buttocks of the user when said back portion of said panel member is coupled to said waist member of said lower portion.

2. The swimsuit undergarment as set forth in claim 1, further comprising:

said upper portion comprising a bodice panel, a bottom edge of said bodice panel being coupled to said lower portion of said body member, said bodice panel being adapted for being positioned on a front of the upper torso of a user such that said bodice panel is for supporting the breasts of the user when said body member is being worn by the user.

3. The swimsuit undergarment as set forth in claim 2, further comprising:

said bodice panel of said upper portion comprising an elastic and flexible material, said elastic and flexible material being adapted for forming around the front of the upper torso and breasts of the user for providing support for the breasts of the user.

4. The swimsuit undergarment as set forth in claim 2, further comprising:

said upper portion of said body member comprising a pair of strap members, each of said strap members extending between a top edge of said bodice panel and said lower portion of said body member such that each of said strap members are adapted for extending over the shoulder and along a back of the user, each of said strap members being adapted for extending over the shoulders of the user for maintaining positioning of said bodice panel of said upper portion and said lower portion of said body member when said body member is being worn by the user.

5. The swimsuit undergarment as set forth in claim 4, further comprising:

each of said strap members comprising a flexible and inelastic material, said flexible and inelastic material being adapted for supporting said lower portion of said body member and said panel member from the shoulders of the user and conforming to the curves in the back of the user when the user is wearing said body member.

6. The swimsuit undergarment as set forth in claim 4, further comprising:

said upper portion of said body member comprising a securing member, said securing member extending between said strap members of said upper portion of said body member such that said securing member is positioned between said bodice panel and said lower portion of said body member, said securing member being for maintaining positioning of said strap members when said body member is being worn by the user.

7. The swimsuit undergarment as set forth in claim 6, further comprising:

said securing member of said upper portion comprising a pair of securing portions, one of said securing portions being coupled to each of said strap members, each of said securing portions comprising a free end such that said free end of one of said securing portions is selectively couplable to said free end of the other of said securing portion for maintaining positioning of said strap members when said body member is being worn by the user.

8. The swimsuit undergarment as set forth in claim 1, further comprising:

said lower portion of said body member comprising a flexible and elastic material, said flexible and elastic material being adapted for conforming to the buttocks, pelvic area and stomach area of the user for supporting the buttocks, pelvic area and the stomach area of the user when the user is wearing said body member.

9. The swimsuit undergarment as set forth in claim 1, further comprising:

said panel member comprising a front portion, said front portion of said panel member extending along said front member of said lower portion from said back portion of said panel member adjacent said pubic member to said waist member of said lower portion, said front portion of said panel member being adapted for being positioned against the stomach area and pelvic area of the user such that front portion of said panel member compresses against the stomach area and the pelvic area of the user to provide a flatter appearance to the stomach area and pelvic area of the user.

10. The swimsuit undergarment as set forth in claim 1, further comprising:

said panel member comprising a plurality of sets of first fastener portions, each of said sets of first fastener portions being coupled to said back portion of said panel member, each of said sets of first fastener portions selectively engaging a set of second fastener portions coupled to said waist member of said lower portion, each of said sets of first fastener portions being positioned in a spaced relationship to a distal end of said back portion of said panel member such that said back portion of said panel member is adapted for providing greater lift to the buttocks and pulling of the thighs of the user by each of said sets of first fastener portions positioned a greater distance away from said distal end of said back portion of said panel member.

11. A swimsuit undergarment for providing a slimmer appearance of the user, the swimsuit comprising:

a body member comprising an upper portion and a lower portion, said upper portion of said body member being adapted for being positioned on an upper torso of the user, said lower portion being adapted for being positioned on a lower torso of the user when said upper portion is positioned on the upper torso of the user;

a panel member being adjustably coupled to an interior surface of said lower portion of said body member such that said panel member is positioned between said lower portion of said body member and the lower torso of the user, said panel member being adapted for raising the buttocks such that said panel member pulls on the skin on a portion of the thighs of the user to provide a slimmer appearance to the associated portion of the thighs when the user is wearing said body member;

said upper portion comprising a bodice panel, a bottom edge of said bodice panel being coupled to said lower portion of said body member, said bodice panel being adapted for being positioned on a front of the upper torso of a user such that said bodice panel is for supporting the breasts of the user when said body member is being worn by the user;

said bodice panel of said upper portion comprising an elastic and flexible material, said elastic and flexible material being adapted for forming around the front of the upper torso and breasts of the user for providing support for the breasts of the user;

said upper portion of said body member comprising a pair of strap members, each of said strap members extending between a top edge of said bodice panel and said lower portion of said body member such that each of said strap members are adapted for extending over the shoulder and along a back of the user, each of said strap members being adapted for extending over the shoulders of the user for maintaining positioning of said bodice panel of said upper portion and said lower portion of said body member when said body member is being worn by the user;

each of said strap members comprising a flexible and inelastic material, said flexible and inelastic material being adapted for supporting said lower portion of said body member and said panel member from the shoulders of the user and conforming to the curves in the back of the user when the user is wearing said body member;

said upper portion of said body member comprising a securing member, said securing member extending between said strap members of said upper portion of said body member such that said securing member is positioned between said bodice panel and said lower portion of said body member, said securing member being for maintaining positioning of said strap members when said body member is being worn by the user;

said securing member of said upper portion comprising a pair of securing portions, one of said securing portions being coupled to each of said strap members, each of said securing portions comprising a free end such that said free end of one of said securing portions is selectively couplable to said free end of the other of said securing portion for maintaining positioning of said strap members when said body member is being worn by the user;

said lower portion of said body member comprising a flexible and elastic material, said flexible and elastic material being adapted for conforming to the buttocks, pelvic area and stomach area of the user for supporting the buttocks, pelvic area and the stomach area of the user when the user is wearing said body member;

said lower portion of said body member comprising a waist member, said waist member being coupled to said upper portion of said body member such that said waist member is adapted for being positioned around the waist of the user, said waist member being adapted for providing support for said lower portion and said panel member from the waist of the user;

said lower portion of said body member comprising a front member, a back member and a pubic member, said front member and said back member being coupled to said waist member of said lower portion, said pubic member extending between said front member and said back member opposite said waist member such that said front member, said back member and said pubic member define a pair of leg apertures adapted for receiving the legs of the user when the user is wearing said body member, said front member of said lower portion being adapted for being positioned over the pelvic area and stomach area of the user, said back member being adapted for being positioned over the buttocks of the user, said pubic member being adapted for being positioned against the pubic area of the user;

said panel member comprising a back portion, said back portion extending between said pubic member of said lower portion and said waist member of said lower portion such that said back portion of said panel member is adapted for being positioned between said back member of said lower portion and the buttocks of the user when said body member is being worn by the user, said back portion being adjustably couplable to said waist member of said lower portion, said back portion of said panel member being adapted for engaging the buttocks of the user such that said back portion of said panel member is for lifting the buttocks of the user and pulling on the thighs of the user for slimming the appearance of the thighs and buttocks of the user when said back portion of said panel member is coupled to said waist member of said lower portion;

said panel member comprising a front portion, said front portion of said panel member extending along said front member of said lower portion from said back portion of said panel member adjacent said pubic member to said waist member of said lower portion, said front portion of said panel member being adapted for being positioned against the stomach area and pelvic area of the user such that front portion of said panel member compresses against the stomach area and the pelvic area of the user to provide a flatter appearance to the stomach area and pelvic area of the user; and said panel member comprising a plurality of sets of first fastener portions, each of said sets of first fastener portions being coupled to said back portion of said panel member, each of said sets of first fastener portions selectively engaging a set of second fastener portions coupled to said waist member of said lower portion, each of said sets of first fastener portions being positioned in a spaced relationship to a distal end of said back portion of said panel member such that said back portion of said panel member is adapted for providing greater lift to the buttocks and pulling of the thighs of the user by each of said sets of first fastener portions positioned a greater distance away from said distal end of said back portion of said panel member.

* * * * *